US006018841A

United States Patent [19]

Kelsay et al.

[11] Patent Number: 6,018,841

[45] Date of Patent: Feb. 1, 2000

[54] FINISHING TROWEL INCLUDING HANDLE

[75] Inventors: Curtis Dwight Kelsay, Springdale, Ark.; Duane Walker Woltjen, Fayetteville, Ak.; Kent Douglas Williams, Clinton, Mo.

[73] Assignee: MarshalltownTrowel Company, Marshalltown, Iowa

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/017,183

[22] Filed: Feb. 2, 1998

Related U.S. Application Data

[63] Continuation of application No. 08/659,085, Jun. 3, 1996, Pat. No. 5,713,096, which is a continuation of application No. 08/352,321, Dec. 8, 1994, Pat. No. 5,522,111, which is a continuation-in-part of application No. 08/025,622, Mar. 2, 1993, Pat. No. 5,327,612.

[51] Int. Cl.[7] ..... B05C 17/10

[52] U.S. Cl. ..... 15/235.4; 15/143.1; 16/421; 16/436

[58] Field of Search ..... 15/235.4, 235.8, 15/143.1, 245.1, 235.5, 235.6, 235.7; 16/111 R, 116 R, 421, 436

[56] References Cited

U.S. PATENT DOCUMENTS

| | | | |
|---|---|---|---|
| 31,436 | 2/1861 | Bisbee | 152/235.4 |
| 162,355 | 4/1875 | Disston | 15/235.4 |
| 314,479 | 3/1885 | Richardson | 15/235.4 |
| 404,667 | 6/1889 | Woodhouse et al. | 16/116 R |
| 747,036 | 12/1903 | Bishop | 15/235.4 |
| 751,356 | 2/1904 | Smith | 15/235.4 |
| 1,055,406 | 3/1913 | Mason et al. | 15/235.4 |
| 1,153,575 | 9/1915 | Rowley | 16/116 R |
| 1,609,704 | 12/1926 | Ellis | 15/235.4 |
| 1,786,043 | 12/1930 | Troutner | 15/235.4 |
| 2,771,325 | 11/1956 | Brunson | 15/235.4 |
| 2,934,936 | 5/1960 | Vernon | 15/235.4 |
| 3,095,594 | 7/1963 | Dornbas | 15/235.4 |
| 3,302,673 | 2/1967 | Forsberg | 145/61 |
| 3,346,905 | 10/1967 | Scarpelli . | |
| 3,368,234 | 2/1968 | Edens, Jr. . | |
| 4,316,302 | 2/1982 | Clark | 15/235.4 |
| 4,381,575 | 5/1983 | Rumpp | 16/111 R |
| 4,467,492 | 8/1984 | Harrington | 15/235.4 |
| 4,639,029 | 1/1987 | Kolonia | 294/57 |
| 4,729,271 | 3/1988 | Kenigson | 81/177.1 |

(List continued on next page.)

FOREIGN PATENT DOCUMENTS

| | | | |
|---|---|---|---|
| 5185514 | 3/1955 | Italy | 15/235.4 |
| 741487 | 12/1955 | United Kingdom | 15/235.4 |
| 854022 | 11/1960 | United Kingdom . | |
| 1076525 | 7/1962 | United Kingdom | 15/235.4 |
| 88-03589 | 5/1988 | WIPO | 15/235.4 |
| WO 93/14687 | 8/1993 | WIPO . | |

*Primary Examiner*—Gary K. Graham
*Attorney, Agent, or Firm*—McAndrews, Held & Malloy, Ltd.

[57] ABSTRACT

A finishing trowel comprised of a blade, a mounting and a handle, wherein the handle is hollow and has a square mounting hole for receiving a square mounting surface. A plastic handle is comprised of a durable inner core material and a grippable outer member. The handle's inner core includes deformable ribs which axially line the mounting hole and provide a secure, lash-free fit onto the mounting surface over a broader range of manufacturing tolerances for the parts. The handle also includes an endcap which cuts into and seals the endcap against an outer grippable material upon tightening of a flanged nut onto the mounting. A lip extends from the handle and encompasses a portion of the mounting to facilitate increased torque transfer from the handle to the mounting and blade. The replaceable handle can also be formed of other grippable materials such as wood.

12 Claims, 5 Drawing Sheets

U.S. PATENT DOCUMENTS

| | | | |
|---|---|---|---|
| 4,739,536 | 4/1988 | Bandera et al. | 16/111 R |
| 4,884,312 | 12/1989 | Clark | 15/239.4 |
| 4,941,232 | 7/1990 | Decker et al. | 16/111 R |
| 5,155,878 | 10/1992 | Dellis | 16/111 R |
| 5,327,612 | 7/1994 | Kelsay | 15/235.4 |
| 5,522,111 | 6/1996 | Kelsay et al. | 15/235.4 |
| 5,713,096 | 2/1998 | Kelsay et al. | 15/235.4 |

FINISHING TROWEL INCLUDING HANDLE

This is a continuation of application Ser. No. 08/659,085 filed Jun. 3, 1996, now U.S. Pat. No. 5,713,096, which is a continuation of Ser. No. 08/352,321 filed Dec. 8, 1994, now U.S. Pat. No. 5,522,111, which is a continuation in part of application Ser. No. 08/025,622 filed Mar. 2, 1993, now U.S. Pat. No. 5,327,612. The entire disclosure of application Ser. No. 08/025,622 including drawings are incorporated herein by reference as if set forth fully in this application.

BACKGROUND OF THE INVENTION

The present invention relates to a trowel handle and more particularly to a finishing trowel handle with a mounting and an interchangeable handle mounted thereto. The handle is angled and rounded at the front portion where the handle meets a post so as to provide a smooth, virtually flush transition between the post and the handle where the users thumb may be frequently placed.

A firm grip upon the handle of a trowel is advantageous to prevent the trowel from turning when troweling concrete or when its edge is being used for dozing concrete from one work area to another. When plastics such as glass-filled nylons, polyolefins, or wood are used for the handle, the low coefficient of friction of the smooth outer surface of the handle allows slippage of the trowel in the user's hand, particularly where the hand becomes wetted from perspiration or concrete.

The present invention's handle can be injection molded from two separate types of plastic, where an outer hand grip is molded from a thermoplastic rubber having a slightly soft, non-slip, rubber-like feel surface. This surface provides a favorable grippability to the handle, added ergonomic comfort for the user, and added aesthetic appeal to the handle's appearance. Furthermore, the inner part of the handle, as molded from a harder plastic, provides inner strength for mounting the handle and using the tool.

When trowels are used to spread concrete, the user tends to fully grasp the body of the handle for control of the angle of the trowel blade's working face presented to the work surface. The user's fingers and palm are prone to become chapped and may develop callouses wherever slippage or chafing occurs between the handle and the hand. A major factor promoting callousing of the hand is the presence of concrete. Concrete serves as an irritant by its abrasiveness as well as its chemical effect on the skin.

The present invention's inner core can be formed from polypropylene which provides a strong, durable, and resilient mounting surface. The polypropylene also provides a smooth, low friction area of transition from the body of the handle to the post where the thumb may rest. The friction of the polypropylene, relative to the friction of the outer hand grip and the post, can be controlled by varying the finish on the exposed portions of the inner core.

Alternatively, the entire handle can also be made from wood in the same exterior shape or other grippable, yet smooth materials which can be formed to have smooth and blended transition to the post.

Present finishing trowels often use injection moldable plastics, such as glass-filled nylons or polyolefins for the handle. However, when hollow plastic handles are used, watertight seals must be maintained around the joints in the component plastic parts because the complete tool is often submerged in water for cleaning. If water leaks into the handle's hollow cavities, then the weight advantage of a hollow structure may be reduced significantly. Often the manufacturing processes become complex and expensive to achieve the tolerances necessary for proper handle assembly with watertight seals.

The present invention provides a practical, ergonomic and effective solution which utilizes lightweight hollow handle cores and inexpensive sealing techniques for the components.

Additionally, injection molded handles are often non-replaceable as they are integrally molded onto the mounting. Heretofore, to be interchangeably replaceable, handles and their component parts and mountings, had to be made within exacting tolerances to achieve proper fit upon replacement. Also, replacement handles are often limited to one material which makes no provision for varied user preferences.

The present invention discloses replaceable parts which may be economically manufactured and interchanged without exacting tolerances to achieve a proper fit upon replacement. Additionally, alternative replacement materials may be used.

SUMMARY OF THE INVENTION

Therefore, it is an object of the present invention to overcome the deficiencies of prior art trowels which make use of solid plastic, metal, wood or other handle materials, or which make use of hollow materials with expensive or ineffective component part seals.

It is a further object of the present invention to provide a trowel handle as an interchangeable replacement part that can be manufactured less expensively and to less exacting tolerances.

It is a further object of the present invention to provide a trowel with a grippable, non-slip outer surface.

It is a further object of the present invention to provide a trowel with an angled and rounded smooth transition at the joint of the handle and the post where the user's thumb may be placed.

It is a further object of the present invention to provide an improved trowel in the combination of handle, mounting and blade.

These and other objects are achieved in a trowel having a replaceable handle with inexpensive parts and watertight seals, along with an angled and rounded smooth transition where the handle joins the post.

DESCRIPTION OF THE PREFERRED EMBODIMENT

Figure 1:
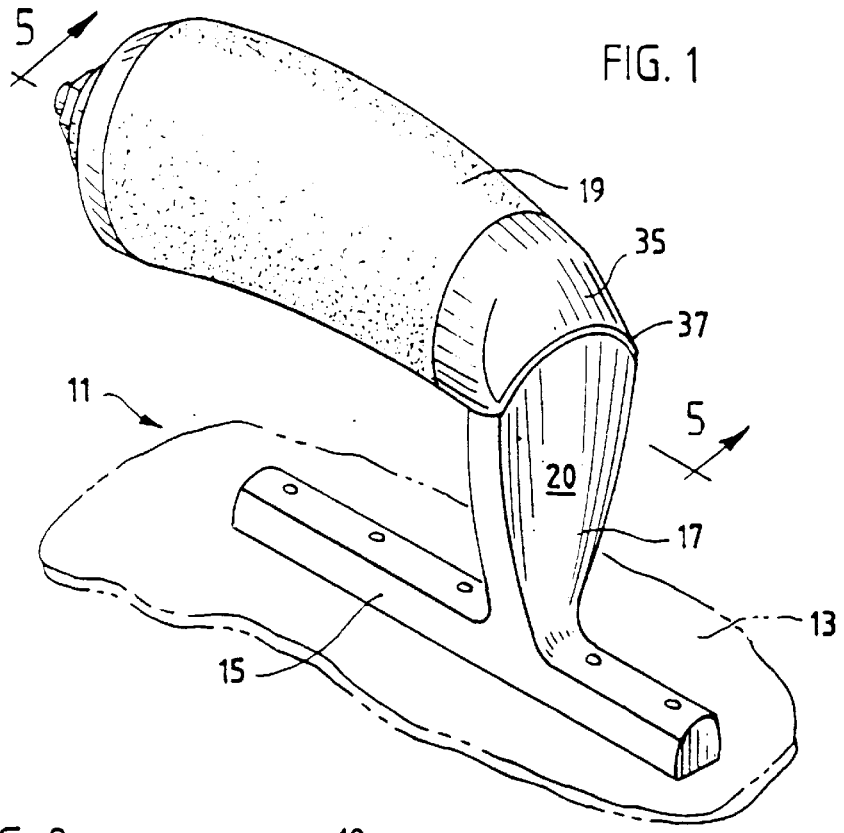
FIG. 1 is a perspective view of a trowel embodiment of the present invention.
Figure 2:
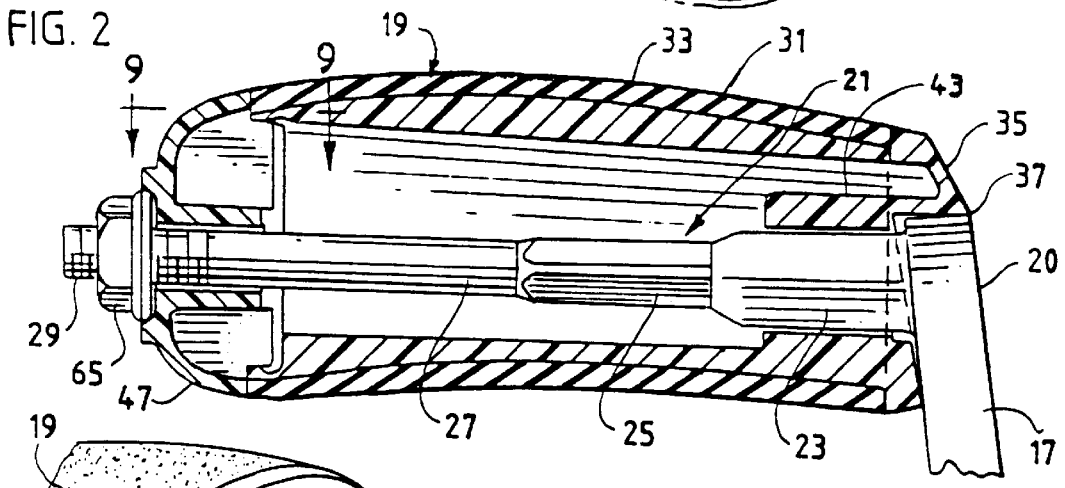
FIG. 2 is a cross-sectional view of the handle of FIG. 1 taken along 5—5 in FIG. 1.

Referring to FIGS. 1 and 2, a trowel 11 is constructed of a flat metal blade 13, a mounting 15, and a handle 19. The mounting 15 is comprised of a mounting rib 88, a post 17 extending upwardly from mounting rib 88 and supporting a tang 21 and a handle 19 in a manner described hereinafter. Post 17 is shaped with a smooth, cylindrically curved front surface 20. Mounting 15 is integrally formed with, or is otherwise secured to, the top surface of blade 13 in any conventional manner.

Figure 3:
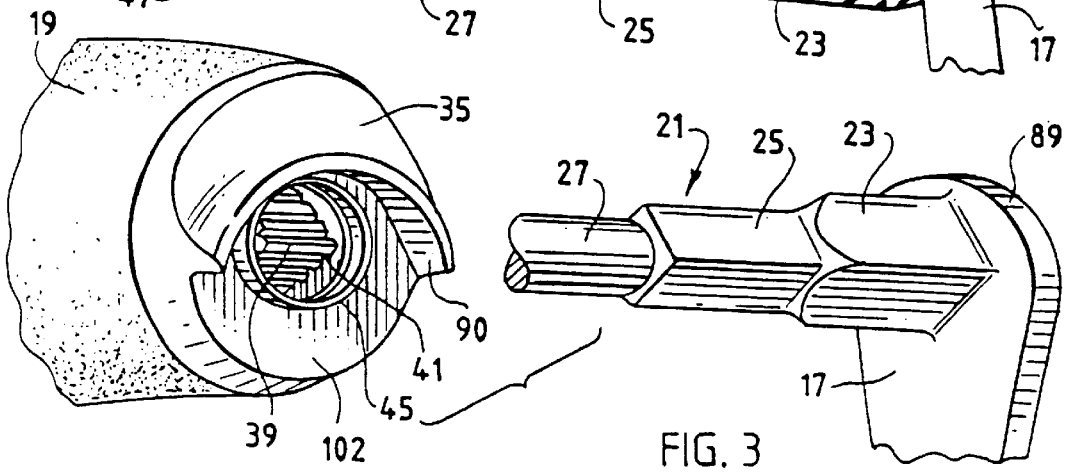
FIG. 3 is an exploded view of the handle mounting, tang, and post and the unmounted trowel handle of FIG. 1.

Referring to FIGS. 2 and 3, tang 21 extends laterally from post 17 and is disposed substantially parallel to and above the plane of blade 13. Mounting 15, as comprised of rib 88, post 17, and tang 21 are typically made of metal as one piece.

Tang 21 includes a proximal section 23, a middle section 25 and a distal section 27. Proximal section 23 is disposed adjacent to post 17 and has a square cross-section. The square cross-section allows more torque to be transferred from handle 19 to tang 21. Middle section 25 of tang 21 is reduced in thickness and likewise has a square cross-section. Distal section 27 is cylindrical in shape, terminating in a threaded portion 29.

The increased transfer of torque between handle 19 and tang 21 might also be achieved by proximal section 23 having any non-circular cross-sectional shape. For example, triangular, rectangular, hexagonal, octagonal, or any other non-circular geometric, or irregular, cross-sectional shape for proximate section 23 will provide superior torque transfer capabilities over circular cross-sectional shapes.

As shown in FIGS. 2 and 3, handle 19 includes a hollow inner core 31 and an outer grip member 33. The inner core 31 may be formed from polypropylene. The polypropylene forms a firm and durable, but resilient mounting surface. The polypropylene also provides for an outer lip 35 for contact with the users thumb whose surface friction can be controlled by varying the polypropylene surface finish for these exposed areas. A somewhat smooth outer lip 35 provides a lower coefficient of friction with the user's thumb when compared to the outer grip 33, thus permitting it to freely slide along the surface during manipulation of the trowel without chaffing drag. In the present embodiment, for example, the surface of outer lip 35 has a matt finish providing only slightly more friction than smooth polypropylene, because this finish is more aesthetically pleasing to consumers.

The outer grip member 33 can be molded from a thermoplastic rubber, e.g. Santoprene, having a slightly soft, non-slip, rubber-like feel surface. This material provides a higher coefficient of friction with the user's fingers and palm thus providing a more grippable and comfortable surface. While the Santoprene could extend over all exposed areas of the inner core 31, such coverage would add expense, lack aesthetic appeal, and retard the said relatively free movement of the thumb.

Inner core 31 has a tapered, arc-shaped lip 35 disposed at the proximal end of handle 19. Lip 35 is terminated flush with the front surface of post 17 to form a smooth transition region 37 (FIG. 1) between the handle's inner core 31 and post 17. This smooth transition is further facilitated by post front surface 20 curving convexly outward. It is preferred that front surface 20 is cylindrical in shape, rather than conical or compoundly curved, for ease in generating matching shape and dimension in manufacturing a smoothly transitioning mounting 15 and handle 19.

The arc-shaped lower surface 90 of lip 35 also encompasses the top surface 89 of post 17. Surface 89 is eccentric to the proximate section 23 of the tang thus allowing for greater torque transfer between the handle 19 and the mounting 15.

Figure 4:
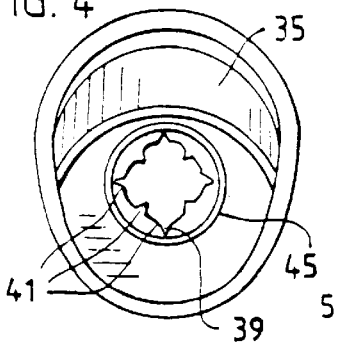
FIG. 4 is a front view of the unmounted trowel handle of the trowel of FIG. 1.

Referring to FIGS. 2, 3, and 4, inner core 31 includes a square shaped mounting hole 39 for receiving the proximate section 23 of the mounting tang in tight interference fit by means of the side surfaces of mounting hole 39 which include a plurality of raised, crushable ribs 41 extending along the axial length of mounting hole 39. Ribs 41 make frictional contact with the outer surface of proximal section 23 and are crushed or deformed as handle 19 is forced onto tang 21. Said crushable ribs 41 provide a means for achieving a secure preloaded lash free fit without the need for more exacting manufacturing tolerances or high assembly forces to have interchangeable handle parts.

As shown in FIG. 2, core 31 includes an inner extended section 43 for providing additional support to the core at the proximal end of the tang 21. Section 43 must be long enough to provide sufficient torque resistance to the tang 21, but short enough so as to maintain the weight advantages of the hollow inner core 31. The necessary length of section 43 varies with the type of material used for core 31. A stronger material allows for a shorter section 43. Alternatively, weaker and often less expensive, materials can be used for core 31 and yet still provide sufficient support by extending section 43. With the embodiment and materials shown, for example, the necessary length of section 43 was approximately 1.25 to 2 times the minimum cross-sectional dimension of mounting hole 39.

Referring to FIGS. 3 and 4, mounting hole 39 is surrounded by a raised annular crushable ring 45 which is crushed or deformed by the back of post 17 (Surface 100 in FIG. 11) upon mounting of handle 19 on tang 21. The crushing of annular ring 45 serves to seal the proximal end of hollow inner core 31 relative to post 17.

This mounting arrangement is also very resilent, particularly in plastic handles when the mounting connection between hole 39 and tang 21 in conjunction with surface 90 and surface 89 of FIG. 3 is torqued to the point of structural failure. For an overtorqued wooden handle, the mounting connection is most often permanently loosened thereby ruining the handle. However, overtorqued plastic handles often restore themselves sufficiently over time and become usable again due to the resiliency of the plastic and the mounting arrangement.

Referring again to FIG. 2, the handle 19 includes an endcap 47 which supports and seals off the distal end of the inner core 31. Endcap 47 is formed from the same material, or a harder material, as that of inner core 31.

Figure 5:
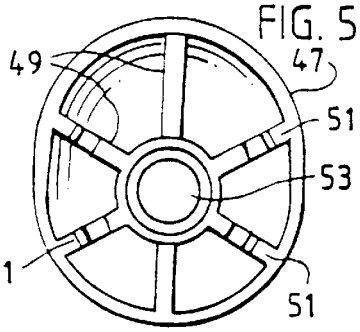
FIG. 5 is a front view of the endcap component of the trowel handle of FIG. 1.
Figure 6:
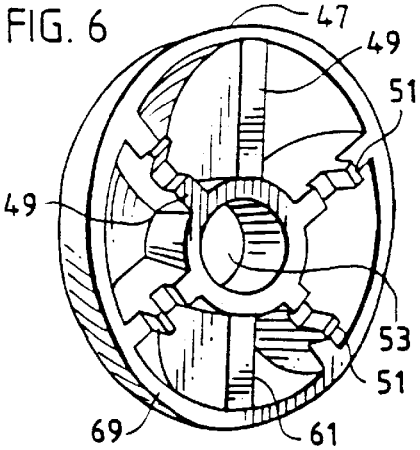
FIG. 6 is an exploded view of the unmounted handle endcap and the handle body of FIG. 1.
Figure 6:
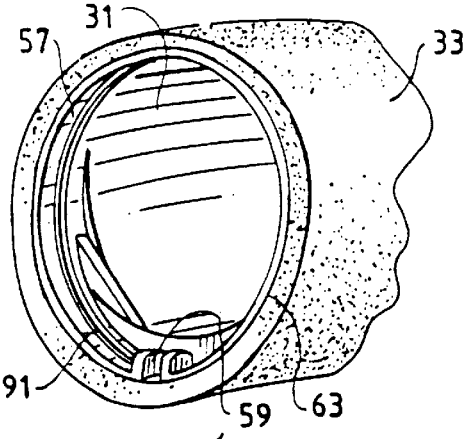

As shown in FIGS. 5 and 6, endcap 47 includes a plurality of ribs 49, a majority of which include a spring tab 51 extending outwardly from the rib. Endcap 47 also includes a through hole 53 for receiving the distal threaded portion 29 of tang 21.

Figure 7:
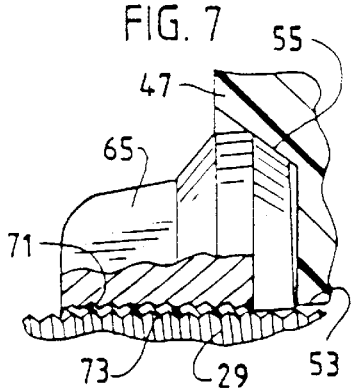
FIG. 7 is a cross-sectional view of the mounting tang threads distal to the post of FIG. 2.

Referring to FIGS. 6 and 7, the back of endcap 47 includes a tapered countersink 55 surrounding hole 53 to facilitate sealing of the flanged nut 65 against the outer grip member 33. The annular surface of nut 65 embeds into surface 55 as nut 65 is advanced on the threaded distal portion 29 of tang 21.

Referring to FIG. 6, to further facilitate mounting of endcap 16, inner core 31 includes a distal end region 57 which terminates in an annular rim 63 where inner core 31 is formed substantially thinner and thus is more easily deformable to pressure. End region 57 includes a guide slot 59 for receiving a guiding endcap rib 61. End region 17 also includes a radial channel 91 for receiving and frictionally engaging endcap spring tabs 51. The receipt of endcap spring tabs 51 into the radial channel 91 holds endcap 47 in place on the handle during the handle assembly procedure until said endcap can be secured by an end nut 65 threaded onto surface 29 of tang 21.

Figure 8:
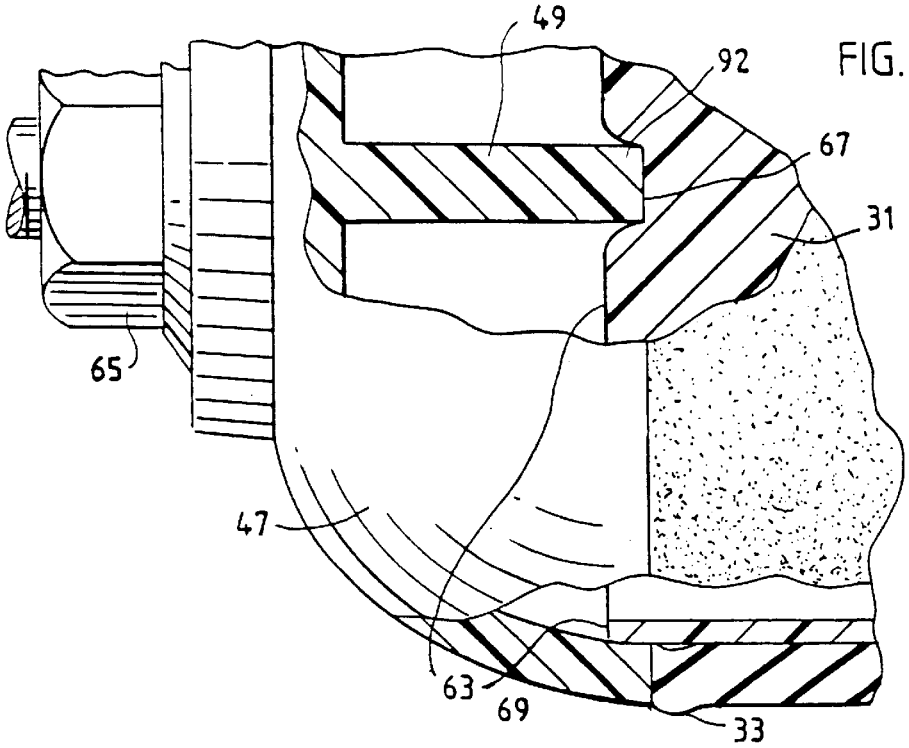
FIG. 8 is a partial cross-sectional side view of the mounted handle endcap of the trowel handle of FIG. 1.
Figure 9:
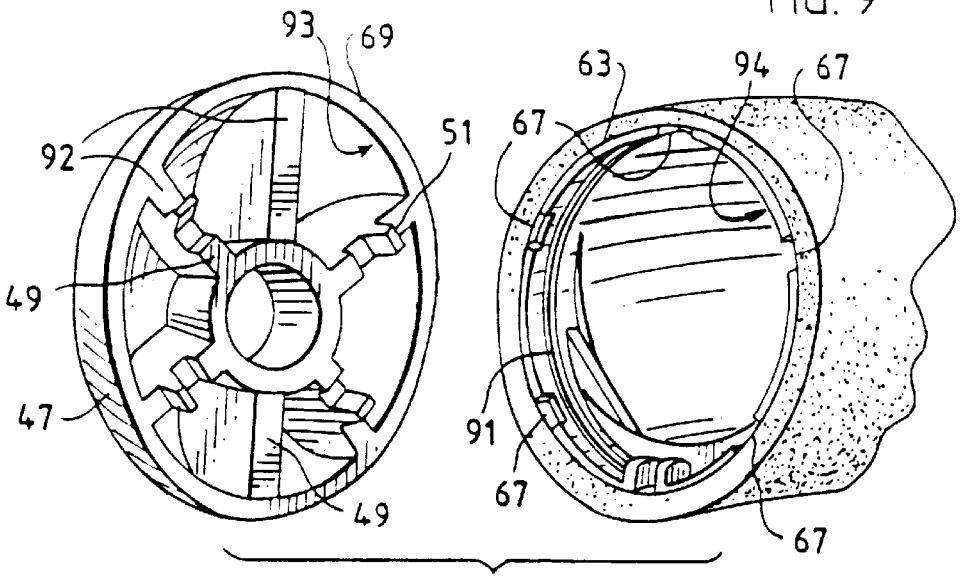
FIG. 9 is an exploded view of the unmounted handle endcap and the handle body of FIG. 1 showing the indentations caused by the ribs of the endcap in the handle body when tightened.

Referring to FIGS. 8 and 9, the tightening of endcap 47 onto mounting tang 21 forces rib contact regions 92 of the endcap to impress into and form indentations 67 in the thinner inner core material of annular rim 63. The inner diameter 93 of endcap outer wall 69 is larger than outer diameter 94 of annular rim 63. Impressed indentations 67 form as endcap 47 moves proximally forward as the nut 65 is tightened so that the endcap outer wall 69 can encompass annular rim 63 and cause compression of the outer grip member 33 to form a watertight seal upon sufficiently tightening end nut 65.

Figure 11:
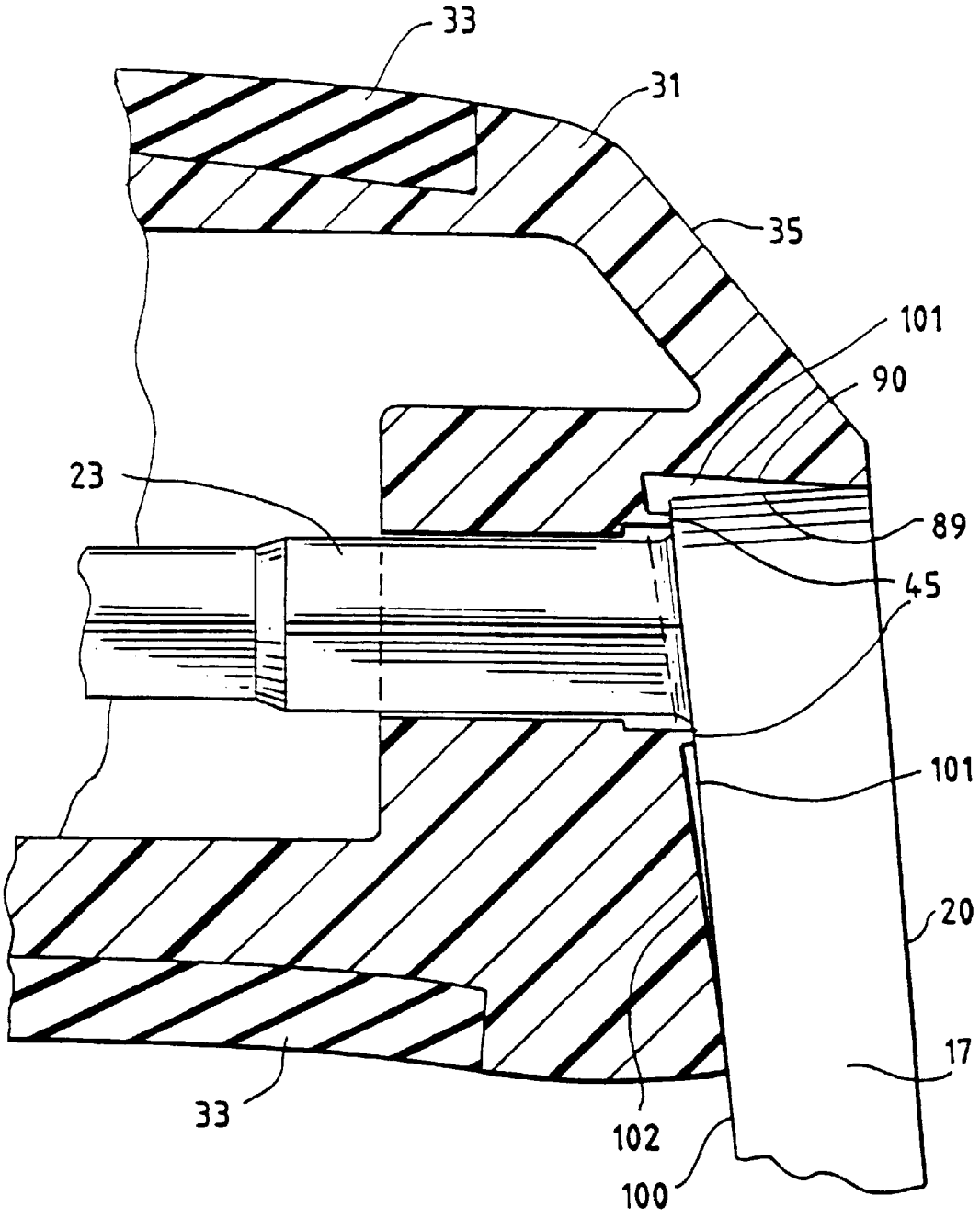
FIG. 11 is a partial cross-sectional view of the front end of the handle and post of FIG. 2 where they are joined.

Referring to FIGS. 3 and 11, inner core 31 also terminates proximally in a front receiving surface 102 below lip 35 and mounting hole 39. Surfaces 89 and 90 are not parallel and 102 and 100 are not parallel so as to create a void volume 101. As handle core 31 is advanced on the proximate portion 23 of the tang, crushing takes place at the interface of surfaces 89 to 90, 100 to 45 and 100 to 102. Crushing of 45 achieves a seal for the hollow core 31. Crushing of 102 and 90 eliminates an opening where cement and sand may lodge making thorough cleanup difficult while also achieving preloaded structural contact for enhanced handle torque resistance, all without requiring difficult and expensive to hold tolerances.

Referring to FIG. 7, the threads 71 of end nut 65 can be coated with a flowable material 73 to further seal threaded surface 29 of tang 21.

Figure 10:
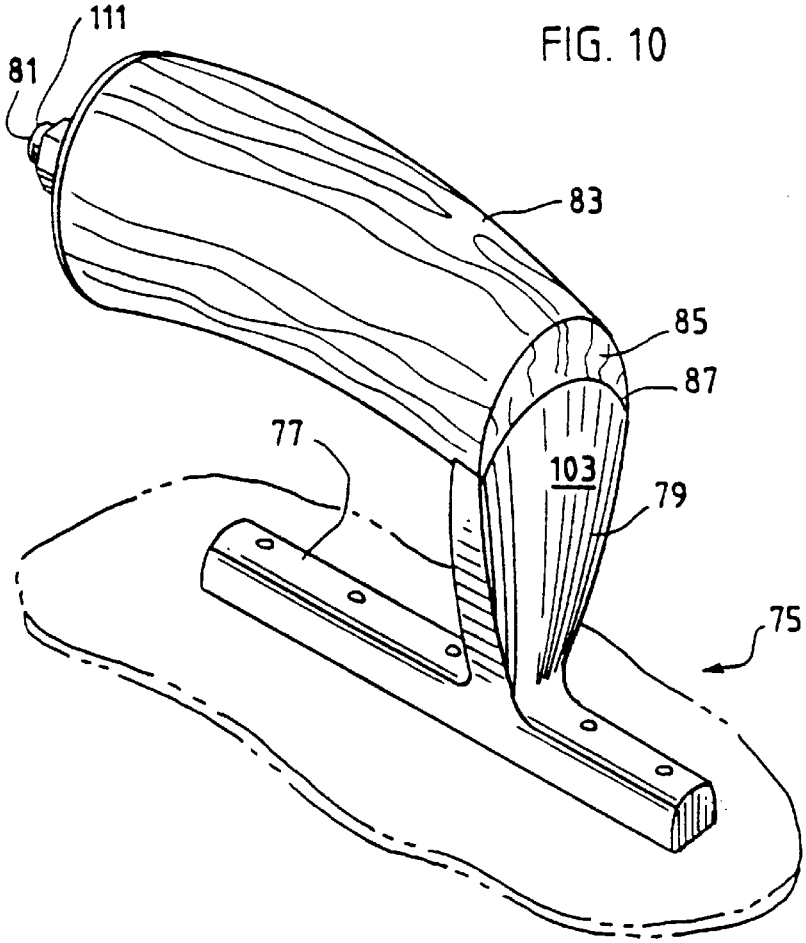
FIG. 10 is a perspective view of another trowel embodiment of the present invention.
Figure 12:
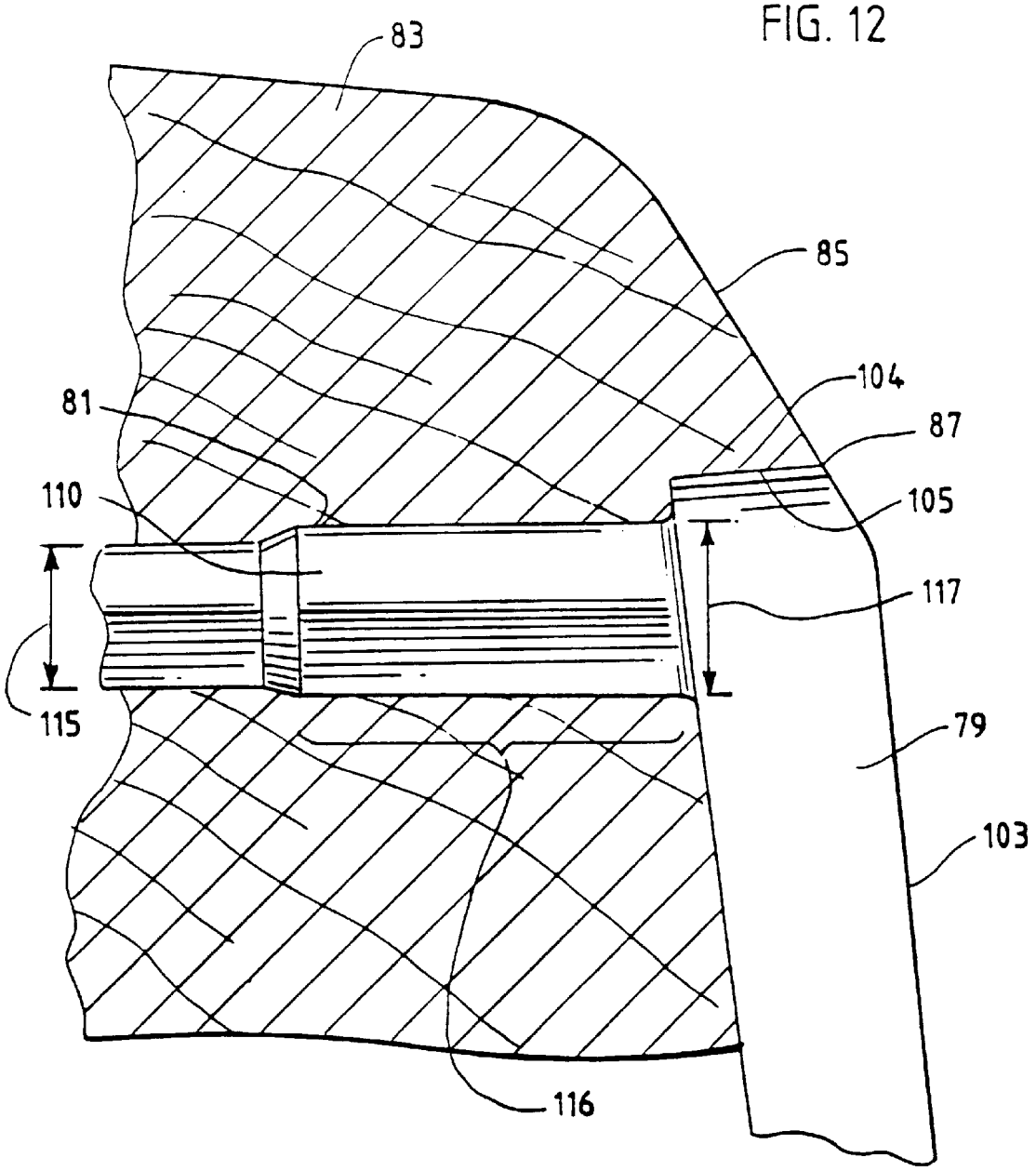
FIG. 12 is a partial cross-sectional view of the front end of the handle and post of FIG. 10 where they are joined.

Referring to FIGS. 10 and 12, an alternative embodiment of the invention includes other handles formed of grippable materials and mounted onto the mounting 75 which is comprised of the rib 77, post 79 and tang 81. Post 79 includes a smooth, cylindrically curved front surface 103 and a top surface 105. Tang 81 includes a proximal section 110 and a distal section 111. Proximal section 110 is disposed adjacent to post 79 and has a square cross-section. The square cross-section allows more torque to be transferred from handle 83 to tang 81. Distal section 111 is cylindrical in shape, terminating in a threaded portion 112.

A solid wooden handle 83 is illustrated mounted onto mounting 75. Handle 83 includes a hollow cavity 115 with a proximal end 116. Cavity end 116 includes a square cross-section 117 for securely receiving proximal end 110 of tang 81.

Handle 83 also includes an angled and rounded arc-shaped lip 85 which has a arc-shaped lower surface 104. The arc-shaped lower surface 104 of lip 85 also encompasses the top surface 105 of post 79. Surface 104 is eccentric to the proximate section 23 of the tang thus allowing for greater torque transfer between the handle 83 and the mounting 75.

Angled and rounded arc-shaped lip 85 also blends to the front of post 79 to form a smooth transition region 87 where the user typically places his thumb. This smooth transition is further facilitated by post front surface 103 curving convexly outward. It is preferred that front surface 103 is cylindrical in shape, rather than conical or compoundly curved, for ease in generating matching shape and dimension in manufacturing a smoothly transitioning mounting 75 and handle 83. Both the material of handle 83 and the metal of post 79 can be further rounded and formed to insure a smooth transition region 87.

While only two preferred embodiments of the invention have been described hereinabove, those of ordinary skill in the art will recognize that either embodiment may be modified and altered without departing from the central spirit and scope of the invention. Thus, the preferred embodiments described hereinabove are to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A trowel comprising:

a blade having a top surface and a bottom surface;

a mounting affixed to the top surface of said blade, said mounting comprising a post extending upwardly from said top surface, said post including a tang extending laterally for a predetermined extent from said post, said tang having a proximal section shaped so as to define four edges;

a handle secured to said tang, said handle having an outer surface, said handle including a core member formed of a plastic material and a grip member secured to said core member, said grip member forming a first portion of said outer surface of said handle and said core member forming a second portion of said outer surface of said handle, said second portion disposed adjacent said post, said core member being hollow along the longitudinal axis of said handle for receiving the majority of the extent of said tang within the hollow, said hollow of said handle defined by an inner surface formed in said core, said inner surface constricted in the area adjacent said proximal section of said tang and engaging said four edges for providing supporting contact to said proximal section of said tang, so as to counteract lateral torquing forces on said handle.

2. The trowel of claim 1 wherein two of said four edges defining a pair of lines which define a plane substantially perpendicular to said top surface of said blade.

3. The trowel of claim 1 wherein said core member has a square shaped mounting hole defined by said inner surface.

4. A trowel of claim 1 wherein said inner surface defines a proximally located mounting hole for receiving said proximal section of said tang, said mounting hole defined by confronting mounting surfaces extending longitudinally into said handle.

5. A trowel according to claim 1 wherein said proximal section of said tang has a cross-section defining a diamond shape with two extreme points of the diamond shape cross-section of said tang defining a line perpendicular to the top surface of said blade and two other extreme points of said cross-section defining a line parallel to the top surface of said blade.

6. A trowel according to claim 1 wherein said tang is made of metal.

7. A trowel comprising:

a blade having a top surface and a bottom surface;

a mounting affixed to the top surface of said blade, said mounting comprising a post extending upwardly from said top surface, said post including a tang extending laterally from said post, said tang having a proximal section;

a handle secured to said tang, said handle having an outer surface, said handle including a core member formed of a plastic material and a grip member secured to said core member, said grip member forming a first portion of said outer surface of said handle and said core member forming a second portion of said outer surface of said handle, said second portion disposed adjacent said post, said core member having a hollow for receiving said tang, said hollow defined by an inner surface formed in said core, said inner surface defining a proximally located mounting hole for receiving said proximal section of said tang, said mounting hole defined by confronting mounting surfaces extending longitudinally into said handle, said mounting surfaces including at least one deformable member, said inner surface receiving in supporting contact said proximal section of said tang, said proximal section of said tang shaped having four edges, said inner surface having a shape for contact with said four edges so as to counteract lateral torquing forces on said handle.

8. A trowel of claim 7 wherein said deformable member is a rib.

9. A trowel according to claim 8 wherein said rib extends inwardly from said mounting surfaces to form longitudinal channels extending distally from said mounting hole.

10. A trowel according to claim 7 wherein said post includes a convex front surface.

11. A trowel comprising:

a blade having a top surface and a bottom surface;

a mounting affixed to the top surface of said blade, said mounting comprising a post extending upwardly from said top surface, said post including, a tang extending laterally from said post, said tang having a proximal section, said proximal section of said tang having a transverse cross-section defining a diamond shape with two extreme points of the diamond shape cross-section of said tang defining a line perpendicular to the top surface of said blade and two other extreme points of said cross-section defining a line parallel to the top surface of said blade;

a handle secured to said tang, said handle having an outer surface, said handle including a core member formed of a plastic material and a grip member secured to said core member, said grip member forming a first portion of said outer surface of said handle and said core member forming a second portion of said outer surface of said handle, said second portion disposed adjacent said post, said core member having a hollow for receiving said tang, said hollow defined by an inner surface formed in said core, a pair of ribs located on said inner surface and positioned relative to at least one of said points for receiving in supporting contact said proximal section of said tang, said proximal section of said tang shaped having four edges, each of said ribs having a shape for contact with one of said four edges so as to counteract lateral torquing forces on said handle.

12. A trowel according to claim 11 wherein said post includes a convex front surface.

* * * * *